US009474395B2

(12) United States Patent
Garg et al.

(10) Patent No.: US 9,474,395 B2
(45) Date of Patent: Oct. 25, 2016

(54) PERCALE BEDDING SYSTEM

(71) Applicants: Kamal Garg, Ahmeda Bad (IN); Gagan Rai, Gurgaon (IN)

(72) Inventors: Kamal Garg, Ahmeda Bad (IN); Gagan Rai, Gurgaon (IN)

(73) Assignee: SKR HOME FASHION, INC., Largo, FL (US)

( * ) Notice: Subject to any disclaimer, the term of this patent is extended or adjusted under 35 U.S.C. 154(b) by 0 days.

(21) Appl. No.: 14/828,868

(22) Filed: Aug. 18, 2015

(65) Prior Publication Data

US 2016/0278551 A1 Sep. 29, 2016

Related U.S. Application Data

(63) Continuation of application No. 14/698,466, filed on Apr. 28, 2015, which is a continuation-in-part of application No. 14/668,124, filed on Mar. 25, 2015.

(51) Int. Cl.

| | |
|---|---|
| ***A47G 9/02*** | (2006.01) |
| ***D03D 15/00*** | (2006.01) |
| ***D03D 1/00*** | (2006.01) |
| ***D03D 13/00*** | (2006.01) |

(52) U.S. Cl.

CPC ..... *A47G 9/0238* (2013.01); *A47G 9/0246* (2013.01); *A47G 9/0253* (2013.01); *D03D 1/0017* (2013.01); *D03D 13/004* (2013.01); *D03D 13/008* (2013.01); *D10B 2201/02* (2013.01); *D10B 2331/04* (2013.01); *D10B 2503/06* (2013.01); *D10B 2503/062* (2013.01)

(58) Field of Classification Search

CPC .... A47G 9/02; A47G 9/0238; A47G 9/0253; A47G 9/0246; A47G 9/0284; A47G 9/0292; D03D 1/007; D03D 13/004; D03D 13/008; D03D 1/0017; D10B 2503/06; D10B 2503/062; D10B 2331/04; D10B 2201/02

See application file for complete search history.

(56) References Cited

U.S. PATENT DOCUMENTS

| | | | | | |
|---|---|---|---|---|---|
| 2,133,237 | A * | 10/1938 | Slayter | D02G 3/182 | 139/420 R |
| 3,327,468 | A * | 6/1967 | Page | D02G 3/06 | 139/420 R |
| 3,604,474 | A * | 9/1971 | Kamei | D03D 1/00 | 139/396 |
| 4,107,371 | A * | 8/1978 | Dean | D03D 9/00 | 139/420 R |
| 4,191,221 | A * | 3/1980 | Boyer | D02G 3/36 | 139/426 R |
| 4,352,380 | A * | 10/1982 | Owen | D02G 3/36 | 139/416 |
| 4,578,306 | A * | 3/1986 | Heiman | D03D 15/00 | 139/420 R |
| 4,670,326 | A * | 6/1987 | Heiman | D03D 15/00 | 139/420 A |
| 5,495,874 | A * | 3/1996 | Heiman | D03D 15/00 | 139/420 A |
| 6,148,871 | A * | 11/2000 | Hassell | B26D 1/035 | 139/420 A |
| 8,186,390 | B2 * | 5/2012 | Krishnaswamy | 139/420 A | |
| 8,230,537 | B2 * | 7/2012 | Stewart | A47G 9/0284 | 139/383 R |
| 8,671,476 | B2 * | 3/2014 | Stewart | A47G 9/0246 | 5/482 |
| 9,131,790 | B2 * | 9/2015 | Agarwal | A47G 9/0238 | |
| 2004/0055660 | A1 * | 3/2004 | Heiman | D03D 15/00 | 139/420 R |
| 2008/0057813 | A1 * | 3/2008 | Tingle | D03D 15/00 | 442/203 |
| 2013/0260104 | A1 * | 10/2013 | Dua | B32B 5/02 | 428/175 |

* cited by examiner

*Primary Examiner* — Robert G Santos
*Assistant Examiner* — David R Hare

(57) ABSTRACT

Percale weave sheeting having warp yarn and weft yarn, the warp yarn and the weft yarn being a cross weave of cotton and polyester.

1 Claim, 5 Drawing Sheets

FIG. 3
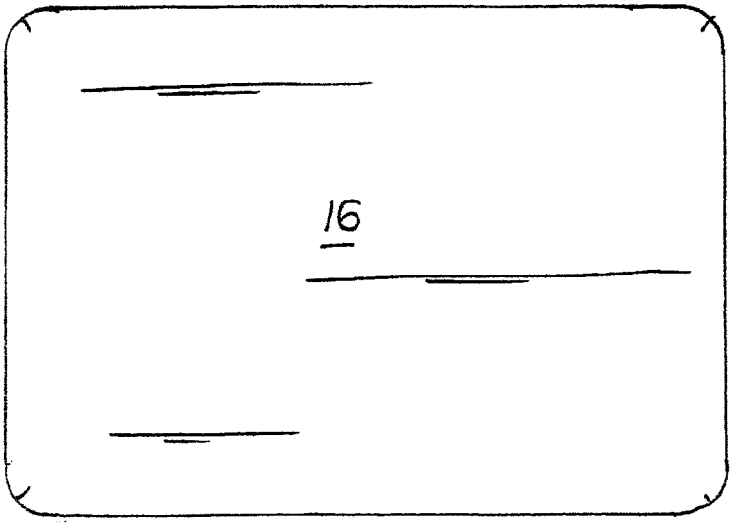
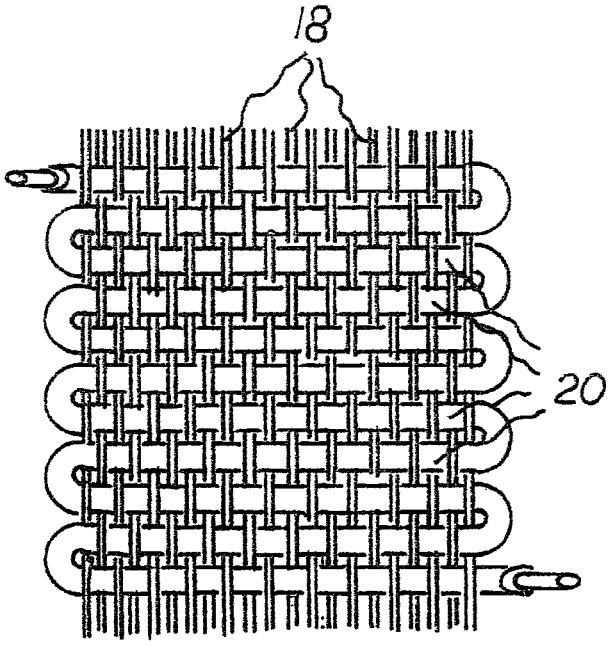
FIG. 4

● SWEET SPOT BEING 60% COTTON BASED ON TEST METHOD AATCC 20&20A

● SWEET SPOT IS 40LBS. X 40LBS. (FOR BOTH WARP & WEFT) AS PER ASTMD5034 TEST METHOD

● SWEET SPOT IN THIS TEST IS GRADE 4·0 AS PER ASTM D4970 (100 MOVEMENT)

PERCALE BEDDING SYSTEM

RELATED APPLICATIONS

The present application is a continuation-in-part of pending application Ser. No. 14/698,466 filed Apr. 28, 2015, which, in turn, is a continuation-in-part of pending application Ser. No. 14/668,124 filed Mar. 25, 2015, the subject matter of which applications is incorporated herein by reference.

BACKGROUND OF THE INVENTION

1. Field of the Invention

The present invention relates to a percale bedding system and more particularly pertains bedding fabricated of a percale fabric characterized by anti-wrinkle capabilities, increased softness and durability/long life, and decreased cost.

2. Description of the Prior Art

The use of bedding fabric of known designs and configurations is known in the prior art. More specifically, bedding fabric of known designs and configurations previously devised and utilized for the purpose of fabricating bedding are known to consist basically of familiar, expected, and obvious structural configurations, notwithstanding the myriad of designs encompassed by the crowded prior art which has been developed for the fulfillment of countless objectives and requirements.

While the prior art fabrics fulfill their respective, particular objectives and requirements, they do not describe percale bedding system that is characterized by anti-wrinkle capabilities, increased softness and durability/long life, and decreased cost.

In this respect, the percale bedding system according to the present invention substantially departs from the conventional concepts and designs of the prior art, and in doing so provides a fabric weave primarily developed for the purpose of fabricating bedding of a percale fabric characterized by anti-wrinkle capabilities, increased softness and durability/long life, and decreased cost.

Therefore, it can be appreciated that there exists a continuing need for a new and improved percale bedding system which can be used for fabricating bedding of a percale fabric characterized by anti-wrinkle capabilities, increased softness and durability/long life, and decreased cost. In this regard, the present invention substantially fulfills this need.

SUMMARY OF THE INVENTION

In view of the foregoing disadvantages inherent in the known types of bedding fabric of known designs and configurations now present in the prior art, the present invention provides an improved percale bedding system. As such, the general purpose of the present invention, which will be described subsequently in greater detail, is to provide a new and improved percale bedding system and method which has all the advantages of the prior art and none of the disadvantages.

To attain this, the present invention broadly is fabric fabricated of percale weave sheeting. The sheeting has warp yarn and weft yarn. The warp yarn and the weft yarn are a cross weave of cotton and polyester.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved percale bedding system which has all of the advantages of the prior art bedding fabric of known designs and configurations and none of the disadvantages.

It is another object of the present invention to provide a new and improved percale bedding system which may be easily and efficiently manufactured and marketed.

It is a further object of the present invention to provide a new and improved percale bedding system which is of durable and reliable constructions.

An even further object of the present invention is to provide a new and improved percale bedding system which is susceptible of a low cost of manufacture with regard to both materials and labor, and which accordingly is then susceptible of low prices of sale to the consuming public, thereby making such percale bedding system economically available to the buying public.

Lastly, it is an object of the present invention to provide a new and improved bedding system fabricated of a percale fabric characterized by anti-wrinkle capabilities, increased softness and durability/long life, and decreased cost.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is front elevational view of the fitted sheet of FIG. 1.

FIG. 4 is an enlarged front elevational view of the fabric of the bedding of the prior Figures.

The same reference numerals refer to the same parts throughout the various Figures.

DESCRIPTION OF THE PREFERRED EMBODIMENT

Figure 1:
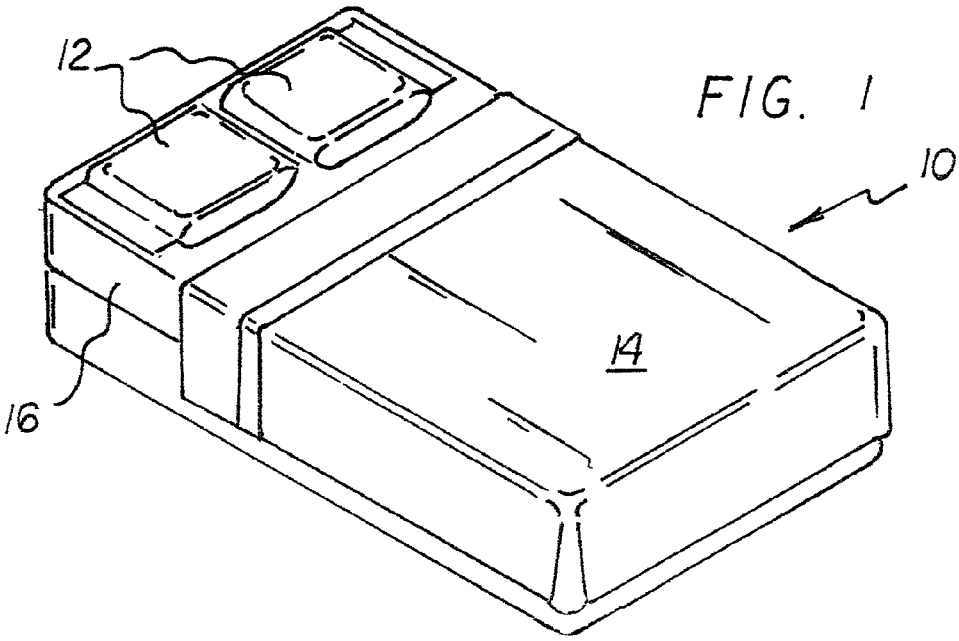
FIG. 1 is a perspective illustration of a percale bedding system fabricated in accordance with the principles of the present invention.
Figure 2:
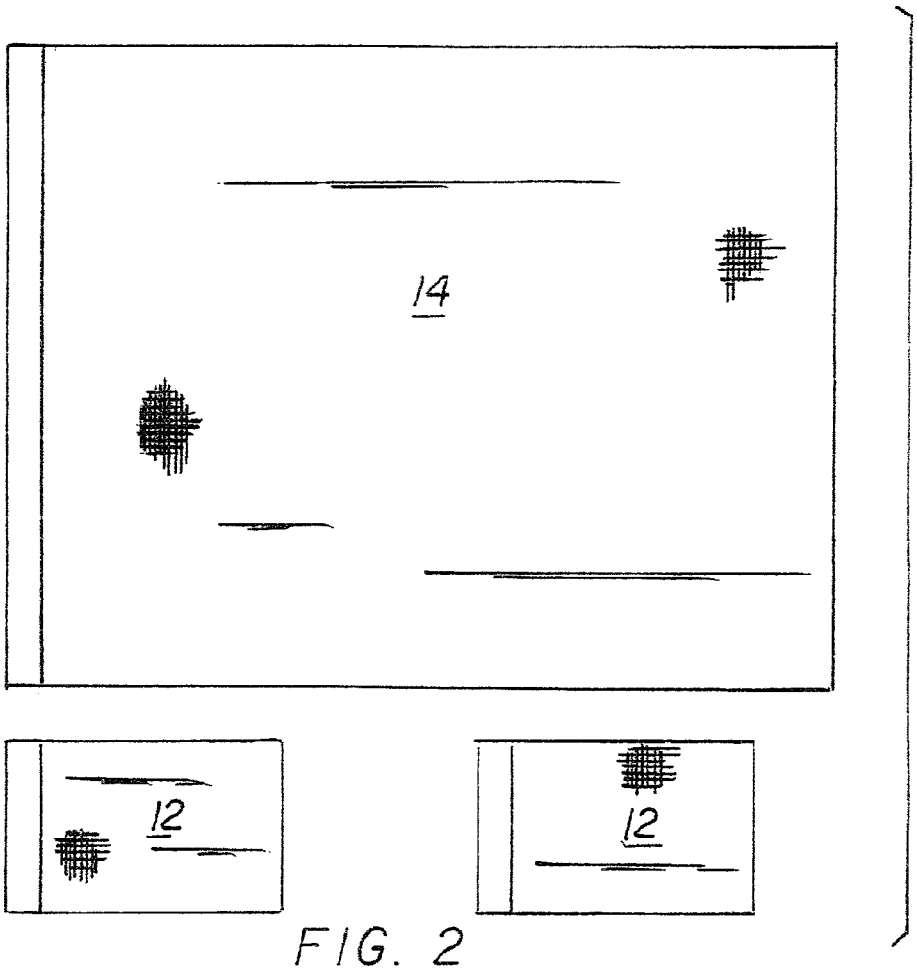
FIG. 2 is a front elevational view of the top sheet and pillow cases of FIG. 1.

With reference now to the drawings, and in particular to FIG. 1 thereof, the preferred embodiment of the new and improved percale bedding system embodying the principles and concepts of the present invention and generally designated by the reference numeral 10 will be described.

The present invention, the percale bedding system 10 is comprised of a plurality of components. Such components in their broadest context include percale weave sheeting having warp yarn and weft yarn, the warp yarn and the weft yarn being a cross weave of cotton and polyester.

In the preferred embodiment, bedding 10 is characterized by anti-wrinkle capabilities, increased softness and durability/long life, and decreased cost. The bedding is fabricated of percale weave sheeting. The bedding includes one, two, or four pillow cases 12, a top sheet 14, and a fitted sheet 16.

The percale weave sheeting has cotton warp yarn 18 with a denier of 15 D to 240 D with 14 filament to 216 filament thread count. The cotton warp yarn has a thread count of 30 s to 60 s. The cotton warp yarn is a rich chief value cotton, CVC, with a 51 percent minimum of cotton and a 49 percent maximum of polyester/filament yarn, or polyester spun yarn, or polyester cotton spun yarn.

The percale weave sheeting has polyester weft yarn 20 with a denier of 15 D to 240 D. The polyester weft yarn is polyester filament, low intermingle. The polyester weft yarn is 14 filament to 216 filament thread count.

The percale weave sheeting has 130 to 1200 threads per square inch. The percale weave sheeting has a weight of 80 to 200 grams per square inch.

The cotton warp yarn and the polyester weft yarn are in a cross weave, 1/1, 1 over 1 and under. The warp and weft, which are preferably cotton and polyester, may be interchanged to polyester warp and cotton weft.

In alternate embodiments, the fabric is formed as a pillowcase, a top sheet, or a fitted sheet. In another alternate embodiment, the bedding includes pillowcases, a top sheet, and a fitted sheet.

In a further alternate embodiment, the cross weave is 1/1, 1 over and 1 under. In another embodiment, the cross weave is 1/2, 1 over and 2 under. In still another embodiment, the cross weave is 1/4, 1 over and 4 under.

The present invention is percale sheeting manufactured into fine products including luxury percale bed sheets, fitted sheets and pillow cases. Such products are characterized by a percale weave construction 1/1, 1 up 1 down, of a high thread count of at least about 130 threads per square inch to 1200 threads per square inch. Prior art percale sheets were either from 100 percent cotton or cotton with polyester filament yarn/polyester or spun yarn/polyester or cotton spun yarn. The sheeting of the present invention is chief value cotton, CVC, that is predominant cotton with the cotton comprising a minimum of 51 percent over polyester filament yarn/polyester spun yarn/polyester cotton spun yarn which will be a maximum 49 percent. The cotton yarn count can vary from 30 s to 60 s thread count and polyester filament yarn/polyester or spun yarn/polyester cotton spun yarn which can vary from 15 D up to 240 D with 14 filament to 216 filament thread count.

The polyester fibers were included in the prior art cotton percale because of the cost of the polyester yarn which was much cheaper than the cotton yarn. Hence, a product with polyester will be cheaper for the consumer, value for money in the hands of the consumer.

The polyester-cotton fabric of the present invention gives wrinkle resistance. Moreover polyester yarn is known for its durability adding to the tensile strength, durability, dimensional stability, wear and tear performance of the fabric of the present invention thereby making it more attractive for the consumer.

Sheeting fabrics suitable for use in the present invention are of a plain weave construction with a thread count of at least about 130 threads per inch up to 1200 threads per inch. Cotton yarn count from 30 s to 60 s with 15 denier to 240 denier with 14 filaments to 216 thread count, and typically have a weight range of about 80 grams per square meter to 200 grams per square meter. They are generally of a substantially balanced construction. The percale weave is a closed construction and is balanced with warp and weft.

The sheeting fabric in accordance with the present invention comprises a woven percale sheeting fabric having a uniform woven fabric construction of at least 130 thread count per inch up to 1200 threads per inch throughout both the sheet areas and the heavier areas. The core spun yarns has a yarn count of about 30 s to 6o s in cotton and 15 D to 240 D of filament polyester/polyester spun yarn/polyester cotton spun yarn.

Percale sheeting fabric can be formed of a single common color, or different colors, or of multiple colors by incorporating into the print, in addition to the oxidizing agent, suitable disperse dyestuffs which sublime into polyester core component. Polyester dyed is in disperse dyeing and cotton in reactive dyeing to match both components of fabric and the print will be in pigment dyes.

Cotton yarn will be from 3o s to 6o s yarn count made from either carded/combed/compact or Egyptian/pima/supima cotton. Percale fabric is woven with warp cotton yarn 100 percent Cotton/Egyptian cotton/Pima/Supima cotton and weft polyester filament yarn/polyester spun yarn/polyester cotton spun yarn. In the alternative, it can be either way with warp polyester filament yarn/polyester spun yarn/polyester cotton spun yarn and weft cotton yarn 100 percent cotton/Egyptian cotton/Pima/Supima cotton.

We have added with polyester filament yarn, polyester spun yarn and polyester cotton spun yarn. The polyester filament yarn may also be CVC.

Figure 5:
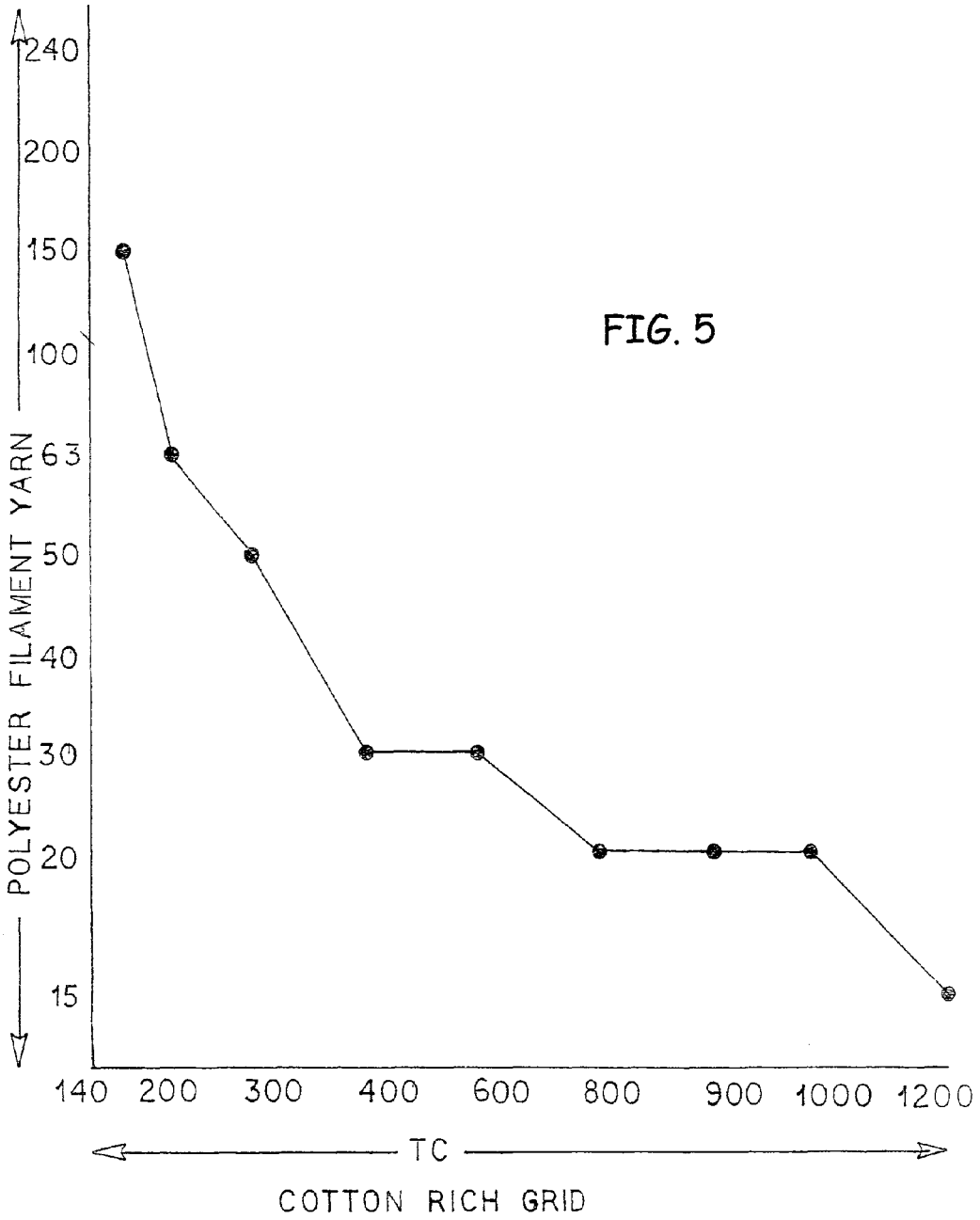
FIG. 5 is a graph charting 15 denier to 240 denier polyester filament yarn against 140 thread count to 1200 thread count threads per inch of cotton rich grid.

FIG. 5 is a graph charting 15 denier to 240 denier polyester filament yarn against 140 thread count to 1200 thread count threads per inch of cotton rich grid. This graph demonstrates that the sweet spot is 60 percent cotton and is based on the test method AATCC 20 and 20A.

Figure 6:
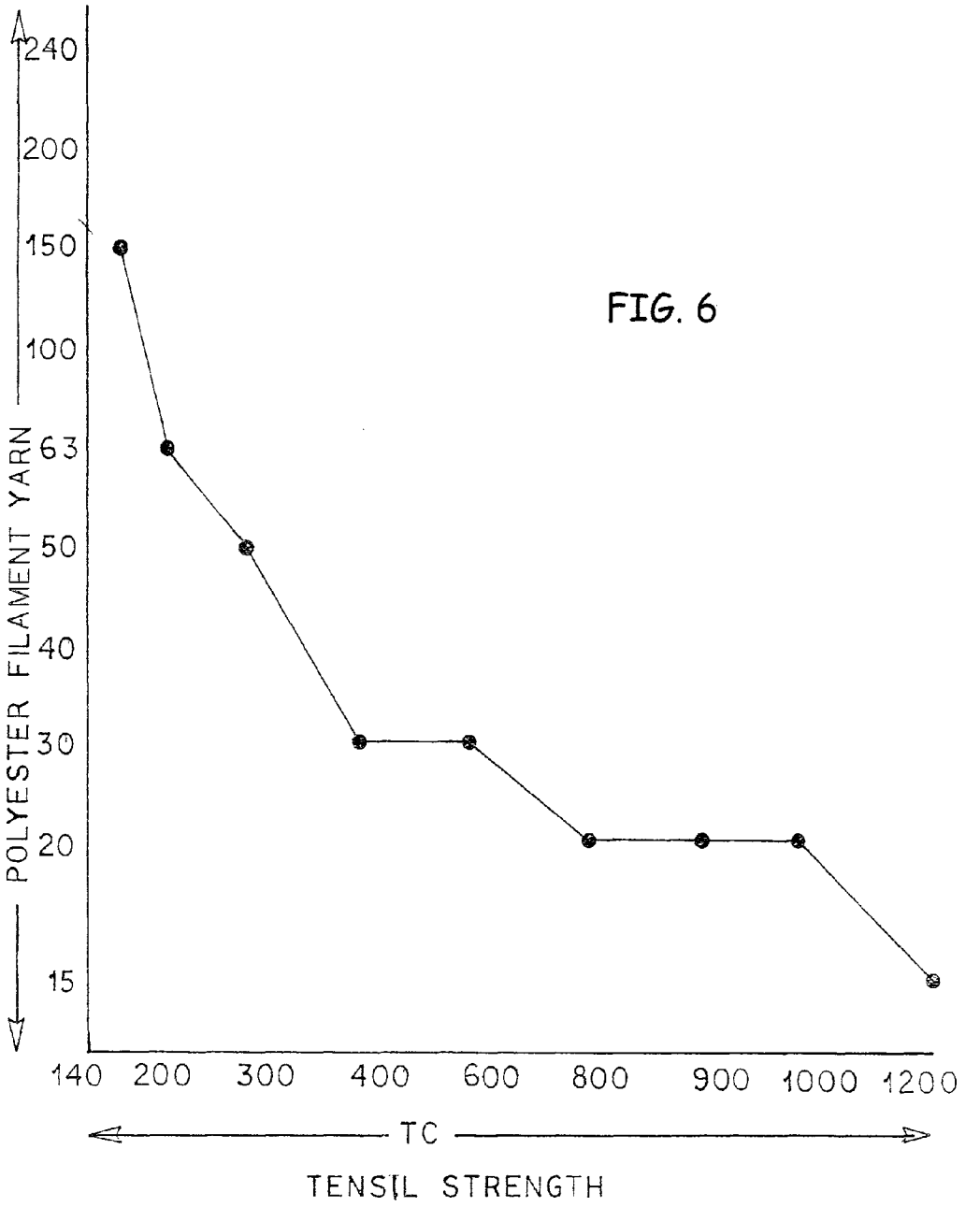
FIG. 6 is a graph charting 15 denier to 240 denier polyester filament yarn against 140 thread count to 1200 thread count threads per inch and measuring tensile strength.

FIG. 6 is a graph charting 15 denier to 240 denier polyester filament yarn against 140 thread count to 1200 thread count threads per inch and measuring tensile strength. This graph demonstrates that the tensile strength is sweet spot is 40 lbs by 40 lbs for both weft and warp as per ASTMD 5034 Test Method.

Figure 7:
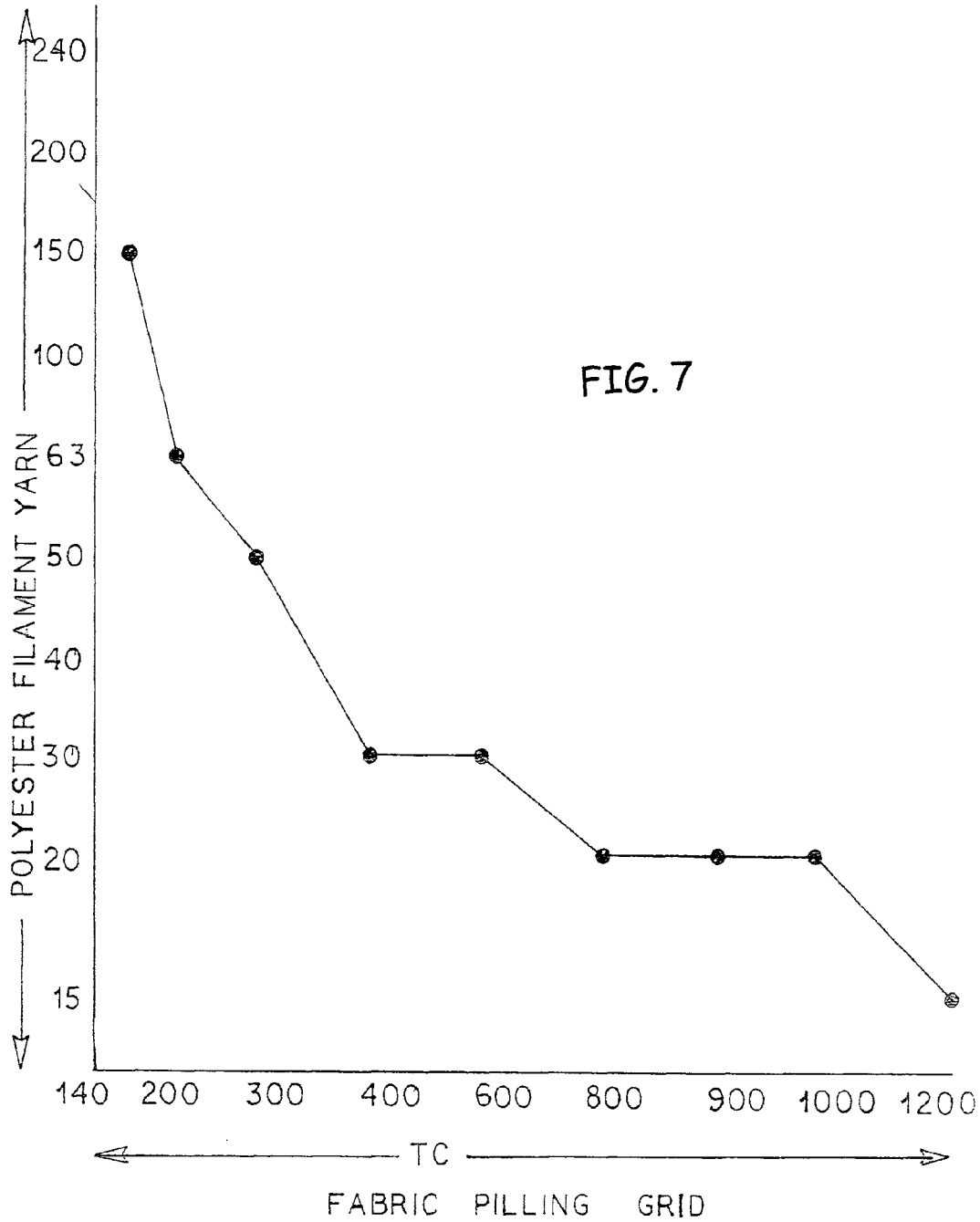
FIG. 7 is a graph charting 15 denier to 240 denier polyester filament yarn against 140 thread count to 1200 thread count threads per inch and measuring fabric pilling grid.

FIG. 7 is a graph charting 15 denier to 240 denier polyester filament yarn against 140 thread count to 1200 thread count threads per inch and measuring fabric pilling grid. This graph demonstrates that the sweet spot in this test is grade 4.0 as per ASTM D4970 (100 Movement).

Note is taken of a comparison between the CVC bedding of the present invention and conventional satin CVC bedding.

a) The cotton content is more in percale weave than in satin weave as in satin weave is 4/1. The present invention has cotton only on the top surface and the bottom is 100 percent polyester, where in percale as it is 1/1 weave so the cotton portion is there on both surfaces so percale bedding is better.

b) The tensile strength is more in percale versus satin.

c) As both surface are the same in the present invention, the color consistency will much higher and even in percale as compared to satin.

d) There is also more crispness in the present invention since cotton is present on both sides in percale vs. satin.

e) Pilling is less and washing is better in percale versus satin as both surfaces are the same.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. Bedding (10) characterized by anti-wrinkle capabilities, increased softness, increased durability/long life, and decreased cost, the bedding comprising:

a percale weave sheeting, the percale weave sheeting having two surfaces, wherein both surfaces exhibit color consistency, the bedding including at least one pillow case (12), a top sheet (14), and a fitted sheet (16);

wherein the percale weave sheeting comprises:

a cotton warp yarn (18) with a yarn count of 30 s to 60 s, a denier of 15 D to 240 D, and 14 to 216 filament;

a polyester weft yarn (20) with a denier of 15 D to 240 D and 14 to 216 filament, low intermingled, thereby providing improved crispness;

wherein the cotton warp yarn and the polyester weft yarn in each surface are a cross weave, 1/1, 1 over 1 and under;

wherein both surfaces comprise a proportion of cotton and a proportion of polyester, the proportion of cotton being greater than the proportion of polyester; and wherein the percale weave sheeting has a high thread count of 130 to 1200 threads per inch thereby exhibiting low pilling, and a weight range of 80 to 200 grams per square meter thereby exhibiting high tensile strength.

* * * * *